US012264887B2

(12) United States Patent
Tanfoglio et al.

(10) Patent No.: US 12,264,887 B2
(45) Date of Patent: Apr. 1, 2025

(54) SAFETY DEVICE FOR A FIREARM

(71) Applicants: FRATELLI TANFOGLIO S.R.L., Gardone val Trompia (IT); T.W. TECNOLOGY S.R.L., Brescia (IT)

(72) Inventors: Massimo Tanfoglio, Gardone Val Trompia (IT); Luciano Camanini, Desenzano del Garda (IT); Diego Gustin, Trieste (IT)

(73) Assignees: FRATELLI TANFOGLIO S.R.L., Brescia (IT); T.W. TECNOLOGY S.R.L., Brescia (IT)

( * ) Notice: Subject to any disclaimer, the term of this patent is extended or adjusted under 35 U.S.C. 154(b) by 183 days.

(21) Appl. No.: 18/096,055

(22) Filed: Jan. 12, 2023

(65) Prior Publication Data

US 2023/0228509 A1 Jul. 20, 2023

(30) Foreign Application Priority Data

Jan. 14, 2022 (IT) ..... 102022000000539

(51) Int. Cl.
*F41A 17/06* (2006.01)

(52) U.S. Cl.
CPC ..... *F41A 17/063* (2013.01)

(58) Field of Classification Search
CPC ..... F41A 17/063; F41A 17/06; F41A 17/066
See application file for complete search history.

(56) References Cited

U.S. PATENT DOCUMENTS

| | | | | |
|---|---|---|---|---|
| 4,682,435 | A * | 7/1987 | Heltzel | F41A 17/063 42/70.11 |
| 6,442,880 | B1 * | 9/2002 | Allan | F41A 17/066 42/70.11 |
| 7,356,959 | B2 * | 4/2008 | Schmitter | F41A 17/063 89/146 |
| 9,651,325 | B1 | 5/2017 | Gant et al. | |
| 9,841,249 | B1 * | 12/2017 | Nicks | H02J 7/0045 |
| 11,215,415 | B2 * | 1/2022 | Delgado Acarreta | F41A 19/10 |
| 11,822,413 | B1 * | 11/2023 | Owens | G06F 1/3287 |
| 11,920,881 | B1 * | 3/2024 | Kloepfer | F41A 19/01 |
| 12,044,501 | B1 * | 7/2024 | Rogers | G06V 40/117 |
| 2002/0112390 | A1 * | 8/2002 | Harling | H04K 3/20 42/70.11 |
| 2006/0242879 | A1 * | 11/2006 | Schmitter | F41A 17/063 42/70.01 |
| 2007/0074438 | A1 * | 4/2007 | Parhofer | F41A 17/063 42/70.01 |

(Continued)

FOREIGN PATENT DOCUMENTS

WO 2007/102181 A2 9/2007

*Primary Examiner* — Joshua E Freeman
(74) *Attorney, Agent, or Firm* — CANTOR COLBURN LLP

(57) ABSTRACT

A safety device for a firearm provided with a grip and having a latch operated by a motor and adapted to be engaged with mechanical parts of the firearm to prevent and/or allow activation of the firearm is provided. A control unit connected to the motor and supplied by at least one battery has an internal transceiver cooperating with an external transceiver for controlling the latch by an authorized user. A capacitive sensor, operatively connected to the control unit for controlling the latch, is adapted to detect presence of a hand of an authorized user on the grip.

12 Claims, 4 Drawing Sheets

(56) References Cited

U.S. PATENT DOCUMENTS

| | | | | |
|---|---|---|---|---|
| 2011/0162514 | A1* | 7/2011 | Osborne | F41H 13/0018 224/191 |
| 2013/0019510 | A1* | 1/2013 | Kemmerer | F41A 17/066 42/70.11 |
| 2013/0019512 | A1* | 1/2013 | Kemmerer | F41A 17/066 42/70.11 |
| 2013/0125441 | A1* | 5/2013 | Westwood | F41A 17/28 42/70.11 |
| 2014/0366419 | A1* | 12/2014 | Allan | F41A 17/06 42/70.11 |
| 2015/0068093 | A1* | 3/2015 | Milde, Jr. | F41A 17/22 42/70.11 |
| 2015/0377574 | A1* | 12/2015 | Cooke | F41A 17/56 42/70.11 |
| 2017/0010062 | A1 | 1/2017 | Black et al. | |
| 2019/0340856 | A1* | 11/2019 | Gilbert | E05B 47/0012 |
| 2020/0370851 | A1* | 11/2020 | Shahbaz | F41A 17/56 |
| 2021/0148665 | A1* | 5/2021 | Delgado Acarreta | F41A 17/06 |
| 2022/0221239 | A1* | 7/2022 | Bombaugh, Jr. | F41A 17/06 |
| 2022/0260337 | A1* | 8/2022 | Haimi | F41C 33/029 |
| 2022/0390200 | A1* | 12/2022 | Faizan | F41A 17/063 |
| 2022/0412682 | A1* | 12/2022 | Delgado Acarreta | F41A 17/20 |
| 2023/0168056 | A1* | 6/2023 | Galie | F41A 17/06 42/69.03 |

* cited by examiner

SAFETY DEVICE FOR A FIREARM

CROSS-REFERENCE TO RELATED APPLICATION

This application claims priority to Italian Patent Application No. 102022000000539 filed on Jan. 14, 2022, the contents of which are incorporated by reference in their entirety.

FIELD OF THE INVENTION

The present invention relates to a safety device for a firearm.

More specifically, the present invention relates to a device of the aforementioned type, designed and manufactured in particular for application to firearms, which makes it possible to limit the use of the firearms exclusively to authorized users.

BACKGROUND OF THE INVENTION

As is well known, for legislative reasons or for defense purposes, for sporting reasons or for hunting, the purchase of firearms by civilian users is increasingly widespread.

The most common types of firearms present in civilian homes are guns or rifles. The main problem is that firearms may be used, even accidentally, by unskilled or unauthorized users, with obvious risks to their own safety and the safety of those around them.

There are already numerous solutions to this problem. Amongst the most common are the use of mechanical devices applicable to the firearm, such as metal wires closed by padlocks or caps to be attached to the cartridge chamber of the firearm. The main problem with these solutions is that the firearm is not always available for use. In other words, in case of necessity or danger, in order to use the firearm it is first necessary to remove the locking devices, an activity that requires some time.

SUMMARY OF THE INVENTION

In light of the above, the objective of the present invention is to provide a safety device capable of preventing the firearm from being fired in the event of activation by an unauthorized person or in the event of the same accidentally falling.

The object of the present invention is therefore to make available a firearm safety device, which permits the use thereof to suitably qualified users only.

This purpose is achieved by a firearm safety device and a firearm as described and claimed herein. Advantageous embodiments of the present invention are also described.

BRIEF DESCRIPTION OF THE FIGURES

The features and advantages of the safety device according to the present invention will become apparent from the following description, given as a non-limiting example in accordance with the figures in the accompanying drawings, wherein.

DETAILED DESCRIPTION

The object of the present invention is a safety device 1 for the prevention of firing on the part of a firearm in the event of activation by an unauthorized person or accidental activation in the event that the firearm accidentally falls. The firearm may be either a short firearm, like a gun, or a long firearm, like a rifle. The figures show, by way of example, a gun 11.

The safety device 1 comprises:

an electromechanical component that actuates a latch 10;

an electronic component that oversees all of the functions of the firearm; and an energy component, or battery 6.

Figure 1:
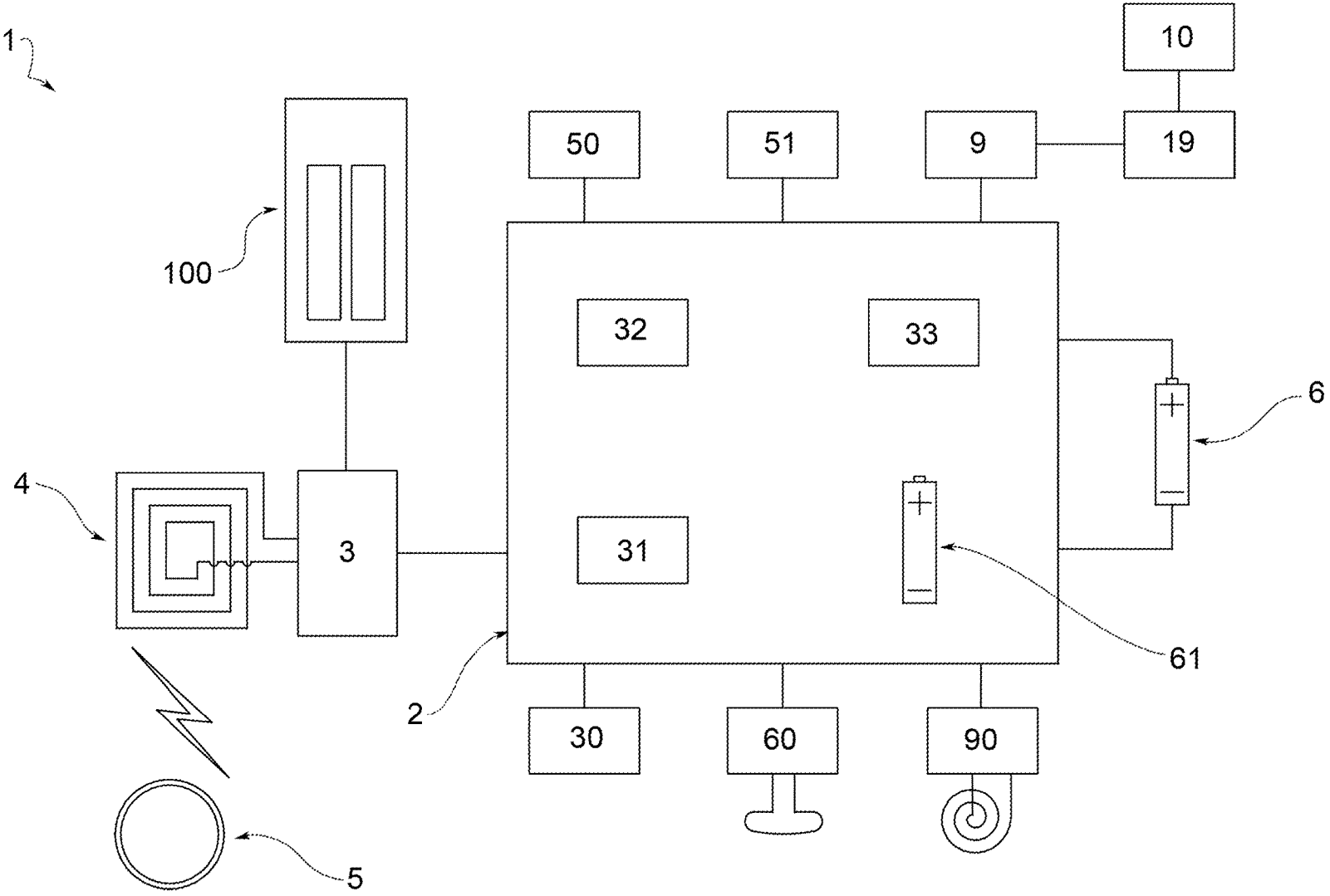
FIG. 1 shows a block diagram of the firearm safety device according to the present invention.
Figure 2:
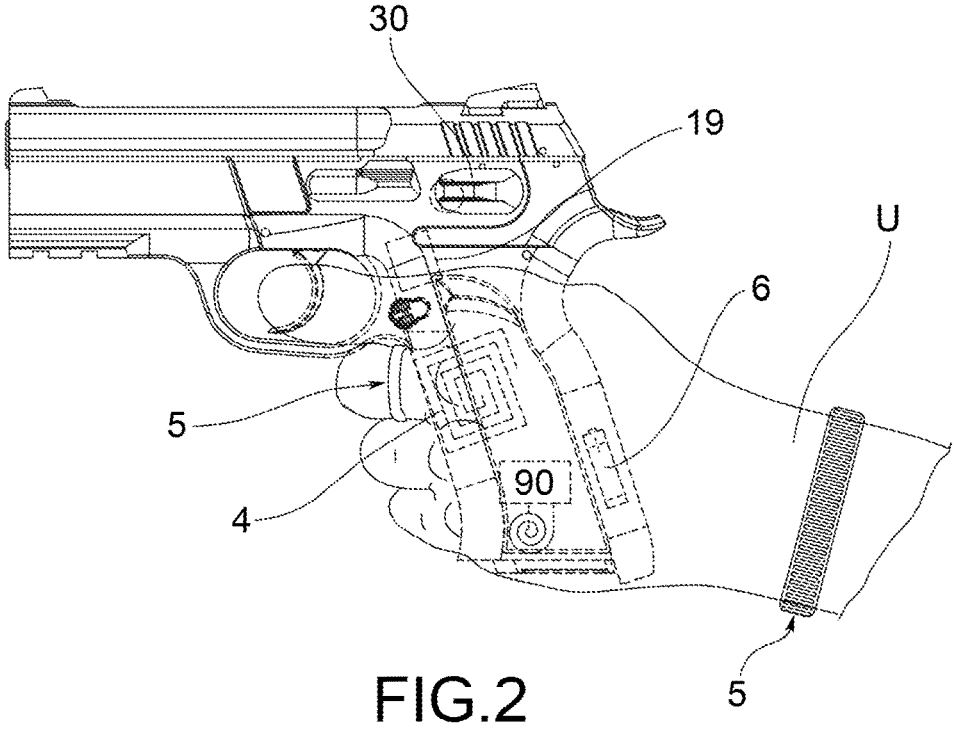
FIG. 2 shows a side view in transparency of a gun held by a user, wherein the safety device according to FIG. 1 is installed.
Figure 3:
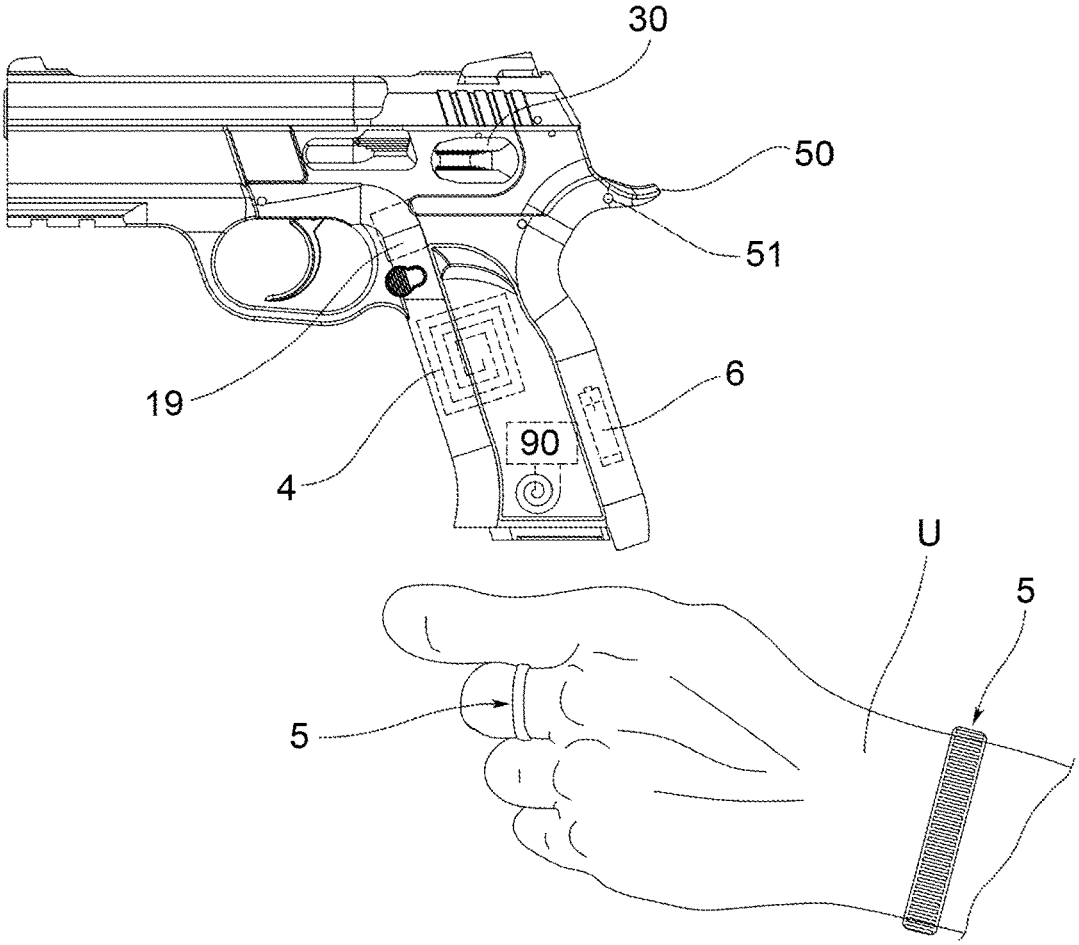
FIG. 3 shows a transparent side view of a gun according to FIG. 2, not held by a user.

Referring to FIG. 1, a block diagram of the firearm safety device 1 according to the present invention may be observed.

Firstly, the on/off activation of the safety device 1 takes place by means of a Hall sensor 30, that is to say a Hall effect integrated circuit, a physical phenomenon for which a potential difference is observed in a transverse direction in a conductor crossed by electric current in a longitudinal direction when the same is subjected to a perpendicular magnetic field. The Hall sensor 30 is activated and deactivated by a magnet 70 that is integral with the mechanical safety lock 71 of the firearm 11 and communicates with a control unit 2. Therefore, the magnet 70 that is integral with the mechanical safety lock 71 turns on the safety device 1, if the mechanical safety lock is in the firing position, or turns it off, if the mechanical safety lock is not in the firing position.

The safety device 1 comprises a control unit 2 or microprocessor or microcontroller, electrically connected to an internal transceiver 3, or HF reader. The internal transceiver 3 comprises an antenna 4. The internal transceiver 3 reads the presence of an external transceiver 5, writes data to the external transceiver 5, reads the status of a capacitive sensor 100 and keeps the antenna 4 in sync with the internal registers.

The control unit 2 and the external transceiver 5 are capable of interacting therebetween when the latter is in the vicinity of the antenna 4, receiving a signal from the external transceiver 5, as better explained hereinbelow.

The control unit 2 is supplied by at least one removable battery 6, arranged in the grip 12 of the firearm 11. In one example, the removable battery 6 is rechargeable, of the lithium or nickel metal hydrate accumulator type. In this case, the removable battery 6 is inductively charged by means of a battery charger 90 arranged in the grip 12 of the firearm 11. In another example, the removable battery 6 is non-rechargeable, such as zinc carbon or alkaline. The management of this energy source (charge, control and capacity) is managed by the control unit 2.

The control unit 2 is electrically connected to all of the main units of the firearm 11. The control unit 2 in the present embodiment is a microprocessor system based on one or more low power consumption microcontrollers. The microprocessor, or microprocessors in the case of a redundant system, has an internal clock (without a quartz crystal) with very low consumption and automotive electrical characteristics.

The control unit 2 supervises all of the functions of the system, i.e.:

1) Reads the status of the removable battery 6,
2) Reads the status of the battery charger 90,
3) Reads the status of the Hall sensor 30 (activation and deactivation),
4) Reads the status of the brightness sensor 31,
5) Reads the status of the capacitive sensor 100,
6) Interrogates and writes to the internal transceiver 3,
7) Controls the motor 19,
8) Reads the status of the current of the motor 19,
9) Controls the interface means, i.e. LED 50.51, and
10) Receives and transfers data to the bilateral communication device 60.

The internal transceiver 3 may be of various types. In this embodiment, it is an HF Reader antenna for an external RFID (Radio Frequency Identification) tag transceiver 5.

The safety device 1 comprises a latch 10, installed inside the firearm, adapted to be engaged with the mechanics of the latter, and in particular with the activation of the trigger 13. In other words, under normal conditions the firearm 11 cannot operate, insofar as the latch 10 inhibits the operation of the trigger 13.

The movement of the latch 10 is controlled by a brushless/stepper motor 19.

The operation of the safety device 1 according to the present invention is better explained hereinbelow.

The internal transceiver 3 generates a signal, which is radiated into the surrounding space by the antenna 4. The internal transceiver 3 is implemented in such a way as to resonate upon the approach of the external transceiver 5.

The external transceiver 5 is arranged on the enabled user's U hand. The external transceiver 5 consists mainly of a resonant circuit, which in turn is connected to an integrated circuit within a ring or cuff or, under the skin.

The signal radiated by the antenna 4 is suitably encoded and modulated. In this way, it is not the case that any external transceiver 5 of the same type may activate the control unit 2. In fact, the transceiver integrated circuit is suitably programmed to recognize the encoded and modulated signal. In particular, the management of the external transceiver 5 takes place using a security protocol of the Advanced Encryption Standard (AES) type, using univocal and non-reproducible keys. The system uses communication with the external transceiver 5 using a varying code (Rolling Code) whereby each time the control unit of the firearm 11 recognizes the external transceiver 5, it writes a new code part thereon, which must be compared during a successive communication.

When the firearm 11 is held by the user U, the external transceiver 5 is at a sufficient distance to allow for the activation of the latch 10. In fact, when the external transceiver 5 is in the vicinity of the antenna 4, it receives the modulated signal at the appropriate frequency and carrying an identification code. The internal transceiver 3 demodulates it, supplying it to the control unit 2. Once said code is recognized, the control unit 2 drives the power unit 9, that induces a drive current into the motor 19 in order to drive the latch 10. In this way, the latch 10 is retracted following the rotary action of the motor 19, disengaging the mechanical parts of the firearm and permitting the use thereof.

In contrast, when the enabled user U releases the grip 12 of the firearm 11, the electromagnetic communication between the external transceiver 5 and the antenna 4 is interrupted and consequently the firearm 11 may no longer be used. In fact, following the removal of the external transceiver 5 from the antenna 4, the internal transceiver 3 informs the control unit 2 that activates the power unit 9 in order to rotate the motor 19, this time in order to move the latch 10 so that it again engages with the mechanical parts of the firearm in locking it.

As mentioned above, the latch 10 engages with the mechanical parts of the firearm 11. In this case, a seat 23, such as a cavity or groove, is provided on a movement transfer lever 18 moved by trigger 13. When the operation of the firearm 11 is inhibited, the latch 10 is inserted into the seat 23, blocking the movement of the trigger 13. Conversely, following the approach of the external transceiver 5 to the antenna 4, the latch 10 disengages from the seat 23, releasing the movement of the trigger 13.

The safety device 1 may also be provided with interface means, such as LEDs 50,51, which indicate the operating status of the firearm 11.

Preferably, there are two red LEDs 51, arranged on the side to indicate the status of the firearm 11, and a blue LED 50, arranged on the back to indicate to the marksman the activation of the firearm and the status of the removable battery 6.

Preferably, for greater operational reliability, the safety device 1 comprises a non-removable battery, or safety battery 61, which is activated in the event that the removable battery 6 is removed in an activated firearm state. Therefore, following the removal of the removable battery 6 with the firearm activated, the safety battery 61 locks the firearm 11, by activating the latch 10, in the case of the removal of the external transceiver 5 or failure of the user to grip the stock of the firearm.

The firearm 11 further comprises a brightness sensor 31, located between the interface means or LEDs 50,51, which checks the ambient brightness, communicates it to the control unit 2 which attenuates, by means of a PWM signal, the brightness of the interface means in order to prevent the marksman from being illuminated in low light conditions.

In order to make the use of the firearm 11 even safer, the safety device 1 comprises a capacitive sensor 100 arranged on the grip 12. The capacitive sensor 100 or Pad, following the gripping of the firearm by the user U, provides the control unit 2 with an additional activated firearm signal. In this way, it is not enough to approach the external transceiver 5 with the antenna 4 in order to activate the latch 10, but it is also necessary to grip the firearm 11 correctly.

In the examples of the figures, the firearm 11 comprises a hammer 16. The safety device may however also be used in the case of firearms without hammer and provided with a percussion device.

The hammer 16 is adapted to strike the bullet supplied from a magazine (inserted into the grip 12) in order to allow for the ignition of the propellant charge. The hammer 16 is operated by a suitable mechanism, connected by a movement transfer lever 18, pivoted on the pin 18' to the trigger 13 in turn pivoted to the gun on the pin 13".

Figure 4:
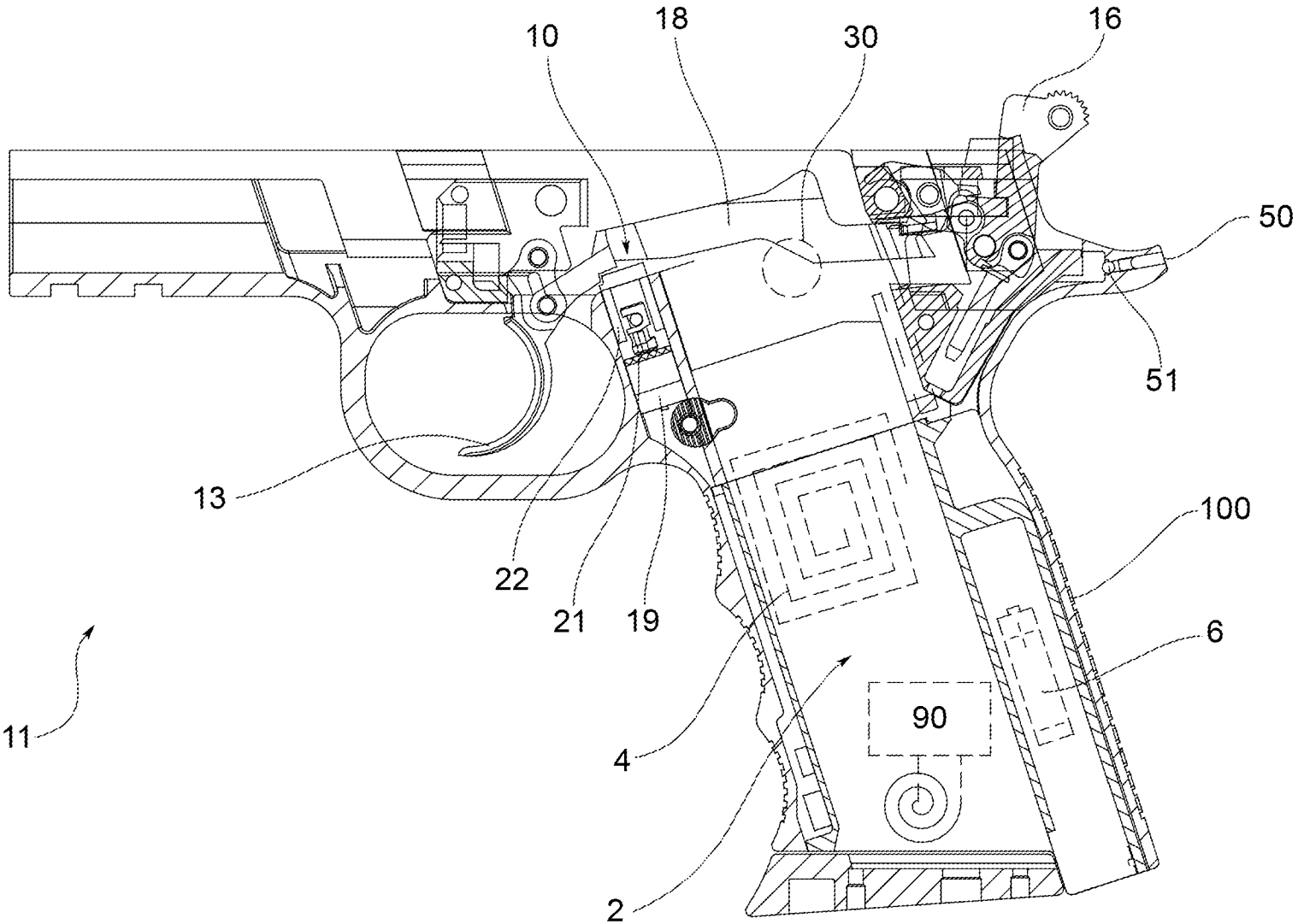
FIG. 4 shows a longitudinal sectional view of a gun wherein the safety device according to FIG. 1 is installed.
Figure 5:
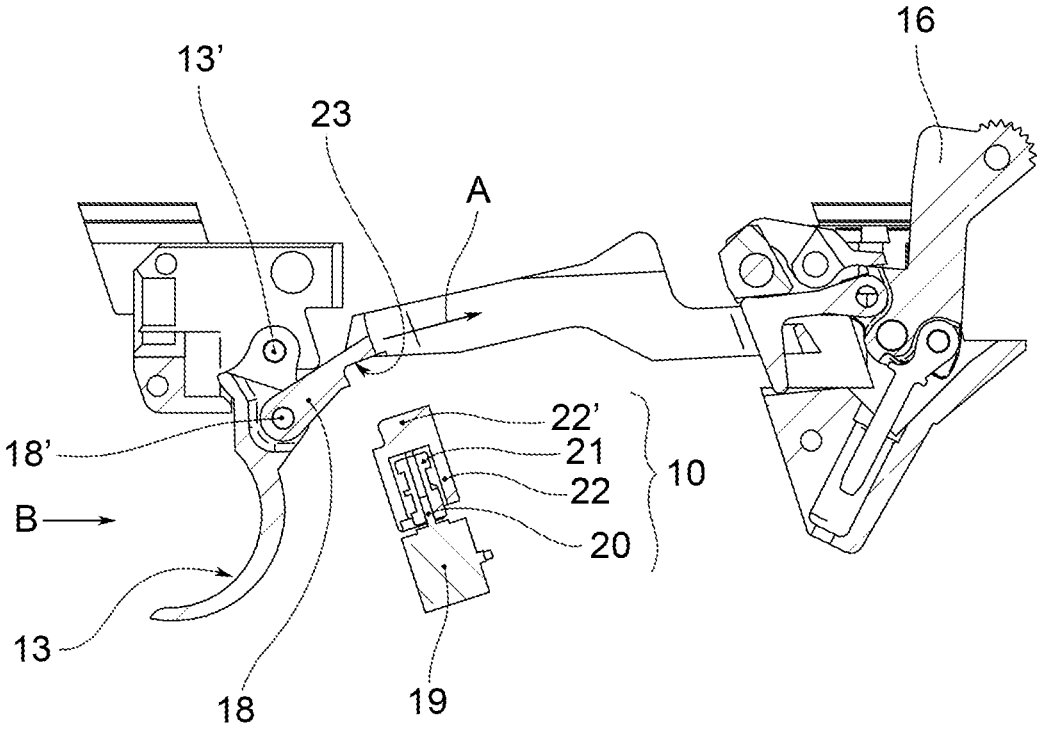
FIG. 5 shows a longitudinal view of the mechanical transmission system between a trigger and a firearm hammer and the interaction therewith of the actuating means of the device according to FIG. 4, in the locked position.
Figure 6:
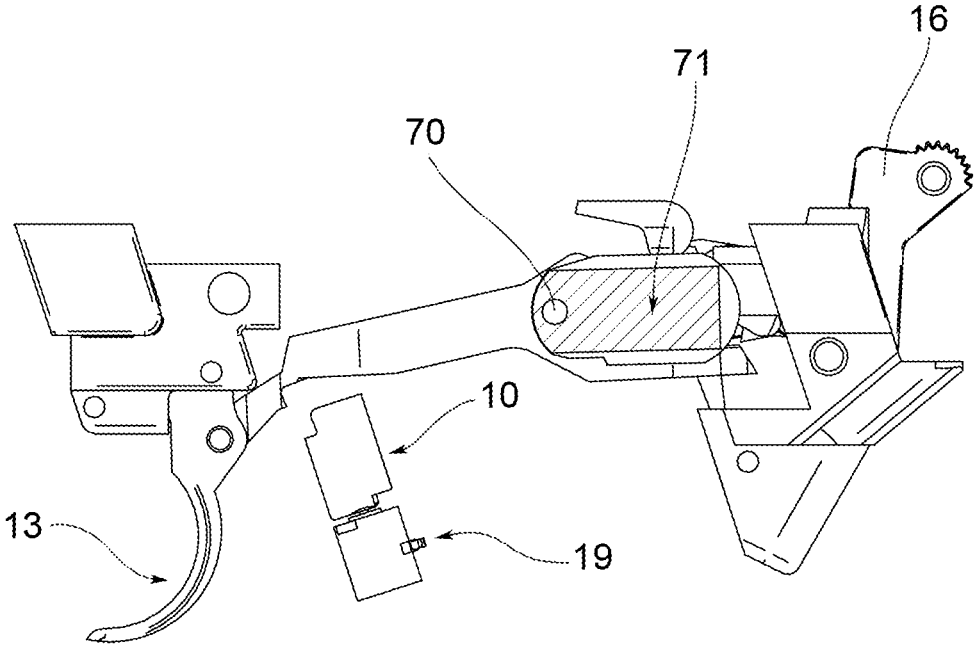
FIG. 6 shows a longitudinal view of the mechanical transmission system between a trigger and firearm hammer, and the manual lock equipped with a Hall sensor.

When the trigger 13 is pushed to the end of the stroke, as in FIG. 4, the movement transfer lever 18 moves in direction A, releasing the hammer 16 which is appropriately preloaded initiating the shot.

The latch 10 comprises an outer body 22, provided with a head 22'. A worm screw 21 is housed inside the outer body 22. The latch 10 is operated by the motor 19 having a shaft 20 keyed onto the worm screw 21, wherein the groove thereof is engaged with a pin protruding inside the outer body 22. As shown in FIG. 4, the motor 19 is housed in the part below the trigger 13 of the firearm 11. The movement transfer lever 18 has a lower seat 23 in which the head 22' of the outer body 22 of the latch 10 is adapted to be engaged in order to lock the firearm. When the head 22' is inserted into the seat 23, by pressing the trigger in the direction B, the movement transfer lever 18 is constrained by the outer body 22 and cannot transfer the movement in the direction A, thereby inhibiting the operation of the firearm, insofar as the hammer 16 remains constrained. When the head 22' is disengaged from the seat 23, by pressing the trigger 13 at the end of the stroke in the direction B, the movement transfer lever 18 moves in the direction A, allowing the activation of the hammer 16, which is appropriately preloaded initiating the shot.

It should be considered that the safety device 1 according to the present invention may be applied to any type of firearm.

The safety device 1 according to the present invention makes it possible to implement a remote control system. In particular, said system is implemented by means of a control and data transmission implemented by two distinct electronic control levels, interconnected with a complete biunivocal security protocol, preferably using a 2.45 GHz transmission protocol.

The firearm 11 has in fact an external environment communication device 60. The communication device 60 is substantially an integrated and miniaturized card in the firearm. The communication device 60 is connected to the main control circuit of the electromechanical locking function of the firearm, i.e. to the latch 11, wherewith it shares the supply of the removable battery 6. The communication device 60 may be located at different points of the firearm, for example in the barrel of a gun or in the wooden or plastic stock of a long firearm.

The firearm 11 further comprises a triaxial accelerometer 32 and an orientation compass 33 and is capable of determining the various situations wherein it is located and write them to the system memory. This data may be viewed externally by means of the communication device 60, using a secure and encrypted communication code and using a security protocol. The communication device 60 is in fact responsible for transmitting and interfacing, preferably in protected mode, with a control apparatus adapted to receive and transmit data by means of a local UMTS network to a management center.

Hereinafter the operating steps of the firearm are described.

i. Initialization Step.

When the removable battery 6 is inserted, nothing must happen. If the battery voltage is sufficient, the control unit 2 (microprocessor) activates and detects the battery type 6 together with the voltage reading. The blue LED 50 (warning signal) is used to signal a low battery by flashing quickly. If the battery voltages are compatible, as expected, and with the safety on, the blue LED 50 does not flash ii. Firearm Off Step.

The control unit 2 has detected a lack of signal from the Hall sensor 30 and switched off the firearm. It has stored the battery voltage and remains in a sleep state waiting for an event in order to wake it up.

The wake-up event may be provided by the Hall sensor 30 or by the electric field present signal from the battery charger 90.

If there is an electric field (charging system), the control unit 2 wakes up to a specific signal from the battery charger 90 and prepares the battery charger according to the type of battery 6 fitted.

iii. Firearm on Step.

The firearm is activated.

The Hall sensor 30 which is always supplied, detects the presence of the magnet 70 incorporated into the mechanical safety lock 71, it changes state and awakens the control unit 2 which:

- turns on the blue LED 50, indicating that the firearm is on but not armed;
- checks the removable battery 6 and if it does not have a suitable voltage, it indicates with fast flashing of the blue LED 50 the need to either charge it or replace it;
- by rotating the motor 19, it brings the latch 10 to the locked position and controls the bottom stroke current;
- searches for the presence of an external transceiver 5 and checks the signal of the capacitive sensor 100 (hand present on the grip 12). In the case of positive verification of the external transceiver 5, that is, if it transfers the correct code (the typical fixed part of the transponder and variable part written during the previous communication), then the unlocking sequence of the firearm is initiated;
- checks the motor current at the end of the stroke;
- activates the red LEDs 51, checks the ambient brightness by means of the brightness sensor 31 and, if low, dims the brightness of the LEDs 50,51 to avoid disturbing the marksman;
- waits for the signal from the capacitive sensor 100 or the external transceiver 5 to disappear and, if this happens, it initiates the firearm safety sequence; and
- if the Hall sensor 30 no longer detects the magnetic field, the firearm is turned off.

During the firearm-on step the control unit 2 communicates with the accelerometer 32 and with the orientation compass 33, and cyclically saves the data. This makes it possible to detect whether the firearm 11 is falling, if the firearm has fired, if the firearm has chambered (a shot has been inserted into the barrel) and the spatial angles of the firearm itself. The control unit 2 will receive, from the communication device 60, the information to enable or disable the firearm 11 from an external server, so as to disable the firearm autonomously (firearm falling) or disable the firearm from an external server.

Innovatively, a safety device in accordance with the present invention is capable of preventing firing on the part of the firearm in the event of actuation by an unauthorized person or in the event of accidental falling of the firearm in a highly reliable and safe manner.

Advantageously, in fact, the safety device 1 also comprises a capacitive sensor 100 adapted to detect the presence of the user's hand on the grip 12 and to provide the control unit 2 with a further activated firearm signal. In this way, it is not enough to approach the external transceiver 5 with the antenna 4 in order to activate the latch 10, but it is also necessary to grip the firearm 11 correctly.

Advantageously in fact, the safety device 1 comprises a non-removable battery, or safety battery 61, which is activated in the event that the removable battery 6 is removed in an activated firearm state. The safety battery 61 locks the firearm 11, by activating the latch 10, in the case of the removal of the external transceiver 5 or failure of the user to grip the stock of the firearm even in the absence of the removable battery 6.

Advantageously, in fact, the safety device 1 comprises a series of sensors, such as the accelerometer 32 and the orientation compass 33, which detect the spatial angles of the firearm and communicate with the control unit 2 so as to disable the firearm autonomously in the event of an accidental fall of the firearm.

Advantageously, in fact, the safety device 1 comprises an external environment communication device 60 that communicates with the control unit 2 so as to disable the firearm by means of an external server.

It is clear that those skilled in the art, in order to meet contingent needs, may make modifications to the safety device described above, all of which are contained within the scope of protection as described and claimed herein.

What is claimed is:

1. A safety device for a firearm provided with a grip, comprising:

a latch, operated by a motor, adapted to be engaged with mechanical parts of the firearm to prevent and/or allow actuation of the firearm; and a control unit operatively connected to said motor and supplied by at least one battery, said control unit comprising an internal transceiver, said internal transceiver being provided with an antenna and cooperating with an external transceiver for controlling said latch by an authorized user;

a capacitive sensor operatively connected to the control unit for controlling said latch, said capacitive sensor being adapted to detect presence of a hand of the authorized user on the grip; and a Hall sensor controlled by a magnet integral with a mechanical safety lock of the firearm, said Hall sensor being operatively connected to the control unit to switch on the safety device when said mechanical safety lock is in a shooting position, and to switch off the safety device when said mechanical safety lock is not in the shooting position.

2. The safety device of claim 1, further comprising:

a removable battery, removably arranged in the grip, for main supply of the control unit; and a safety battery unremovable from the grip, to supply power to the control unit in the absence of the removable battery.

3. The safety device of claim 1, further comprising a communication device for communicating with an external system, said communication device being operatively connected to the control unit to remotely control said latch so as to externally deactivate the firearm.

4. The safety device of claim 1, further comprising a triaxial accelerometer and/or an orientation compass operatively connected to the control unit for automatically controlling said latch so as to independently deactivate the firearm in the event of an accidental fall of the firearm.

5. The safety device of claim 1, wherein the internal transceiver is a high-frequency (HF) reader antenna for an external radio frequency identification (RFID) tag transceiver.

6. The safety device of claim 1, wherein the motor is a brushless motor or a stepper motor.

7. The safety device of claim 1, wherein the external transceiver uses an Advanced Encryption Standard (AES) safety protocol with non-reproducible and univocal keys.

8. The safety device of claim 1, wherein the external transceiver uses a safety protocol with a rolling code whereby each time the control unit recognizes the external transceiver, the control unit writes on the external transceiver a new code part necessary for a successive identification.

9. The safety device of claim 1, in which the latch further comprises an outer body, provided with a head, adapted to engage a lower seat of a movement transfer lever in order to lock the firearm.

10. The safety device of claim 1, in which when the head is inserted into the seat, by pressing the trigger in the direction B, the movement transfer lever is constrained by the outer body and cannot transfer the movement in the direction A, inhibiting the operation of the firearm.

11. The safety device of claim 1, in which when the head is disengaged from the seat, the movement transfer lever moves in the direction A, allowing the activation of the hammer.

12. A firearm comprising:

a safety device provided with a grip, comprising:

a latch, operated by a motor, adapted to be engaged with mechanical parts of the firearm to prevent and/or allow actuation of the firearm;

a control unit operatively connected to said motor and supplied by at least one battery, said control unit comprising an internal transceiver, said internal transceiver being provided with an antenna and cooperating with an external transceiver for controlling said latch by an authorized user;

a capacitive sensor operatively connected to the control unit for controlling said latch, said capacitive sensor being adapted to detect presence of a hand of the authorized user on the grip; and mechanical parts that allow actuation of the firearm, the mechanical parts comprising a movement transfer lever connected at one end to a trigger and at an opposite end to a hammer; and a Hall sensor controlled by a magnet integral with a mechanical safety lock of the firearm, said Hall sensor being operatively connected to the control unit to switch on the safety device when said mechanical safety lock is in a shooting position, and to switch off the safety device when said mechanical safety lock is not in the shooting position wherein the latch is engaged in a seat provided in the lever for locking movement of the trigger.

* * * * *